US005954439A

United States Patent [19]

Brannan et al.

[11] Patent Number: 5,954,439

[45] Date of Patent: Sep. 21, 1999

[54] PRINTER PAPER CUTTING MECHANISM FOR AUTOMATED TELLER MACHINE

[75] Inventors: Jeffrey A. Brannan, Canton; Tuyen Van Pham, Massillon; Thomas S. Mason, Canton; Jay Paul Drummond, Massillon; Jeffrey A. Hill, Canton, all of Ohio; Paul T. Bruss, Riverton, Wyo.; Mark B. Hammer, Riverton, Wyo.; Jim Rowe, Riverton, Wyo.; David J. Walson, Lander, Wyo.; Robert J. Brice, Riverton, Wyo.

[73] Assignee: InterBold, North Canton, Ohio

[21] Appl. No.: 09/154,901

[22] Filed: Sep. 17, 1998

Related U.S. Application Data

[62] Division of application No. 08/213,411, Mar. 15, 1994, Pat. No. 5,816,720.

[51] Int. Cl.[6] ..... B41J 11/70

[52] U.S. Cl. ..... 400/621; 83/614

[58] Field of Search ..... 400/621, 593; 101/226; 83/482, 485, 614

[56] References Cited

U.S. PATENT DOCUMENTS

| | | | |
|---|---|---|---|
| 3,949,857 | 4/1976 | Peters et al. | 400/621 |
| 3,951,252 | 4/1976 | Selke et al. | 400/621 |
| 4,396,305 | 8/1983 | Shattuck et al. . | |
| 4,504,162 | 3/1985 | Speraggi | 400/621 |
| 4,979,838 | 12/1990 | Yokota et al. | 400/621 |
| 4,981,059 | 1/1991 | Kobayashi | 83/76.7 |
| 4,984,913 | 1/1991 | Silverman et al. . | |
| 4,990,011 | 2/1991 | Underwood et al. . | |
| 5,066,153 | 11/1991 | Stephens | 400/621 |
| 5,088,945 | 2/1992 | Ondue . | |
| 5,205,662 | 4/1993 | Kurokawa et al. . | |
| 5,224,786 | 7/1993 | Takagi et al. . | |
| 5,267,802 | 12/1993 | Parnell et al. . | |
| 5,314,179 | 5/1994 | Oda et al. . | |
| 5,531,530 | 7/1996 | Kuraamoto et al. | 400/593 |

FOREIGN PATENT DOCUMENTS

| | | |
|---|---|---|
| 454092 A2 | 10/1991 | European Pat. Off. . |
| 545898 A2 | 6/1993 | European Pat. Off. . |
| 555057 A2 | 8/1993 | European Pat. Off. . |
| 2097767 | 11/1982 | United Kingdom . |

*Primary Examiner*—Christopher A. Bennett
*Attorney, Agent, or Firm*—Ralph E. Jocke

[57] ABSTRACT

A statement printer in an automated teller machine includes a guide block (86) which supports a print head (110). The print head prints on paper (130) which is moved adjacent thereto as the guide block moves transversely relative to the paper. A cutter disk (76) is supported by the guide block. The cutter disk is journaled on an arm (82). The arm is connected to an actuating lever (92). The actuating lever is engageable with stops (106) near the transverse extremes of travel of the guide block. Selective engagement of the actuating lever with the stops moves the cutter disk between cutting and non-cutting positions. Cam members (108) adjacent to the stops dispose the cutter disk away from a cooperating cutter bar (74) as the cutter disk moves between the cutting and non-cutting positions.

21 Claims, 16 Drawing Sheets

PRINTER PAPER CUTTING MECHANISM FOR AUTOMATED TELLER MACHINE

This application is a divisional of application Ser. No. 08/213,411 filed on Mar. 15, 1994 which is now U.S. Pat. No. 5,816,720.

TECHNICAL FIELD

This invention relates to banking devices and particularly to automated teller machines. Specifically this invention relates to a printer mechanism for use in an automated teller machine that can be used to print customer statements, checking account statements, vouchers, scrip, and other documents. Specifically this invention relates to an apparatus and method for cutting paper in the printer mechanism.

BACKGROUND ART

Automated teller machines (ATM's) are known in the prior art. Banking customers may access their accounts using a magnetically encoded card. Generally the customer will insert their card into the ATM which will correlate the identifying information encoded on the card with a personal identification number provided by the customer. This verifies the customer's identity to the computer system which operates the machine. Thereafter the customer may use the ATM to conduct banking transactions as well as to check the status of various accounts that they have with the financial institution. When all the transactions and inquiries are completed, the customer will receive his card back from the ATM along with one or more receipts documenting the transactions performed.

As more people conduct their banking transactions electronically using ATM's, there is a need to provide more information concerning the status of their accounts. Customers often want to know, for example, what checks have cleared and/or what other deductions and/or charges may have been applied against their accounts. Customers may also wish to obtain information about other services provided by the financial institution such as investments, retirement accounts or the terms available for loans.

It is usually not possible to print much information on a receipt that is provided by an ATM. This is because such receipts are usually fairly small in size and are much like a cash register tape. To provide all the information that customers want in a legible format, larger sheets are needed.

Given the space constraints within the interior of an automated teller machine, it has been difficult to obtain enough space to accommodate a printer that can print large sheets. Because ATM's must operate unattended for extended periods of time, a substantial quantity of paper is required. Large sheets of paper will consume valuable space within the automated teller machine and further complicate incorporating a suitable printing mechanism.

Other factors also present difficulties in attempting to use statement printers within an automated teller machine. Wide sheets of paper tend to pucker or become caught when fed into printers. This problem is complicated due to the confined space within an automated teller machine. As a result, properly threading the paper into a printer becomes a problem. A similar problem is the need to periodically change the ribbon cartridge on the printers. Due to the limited space and access, it is often difficult to properly align and secure a new print cartridge after the previous cartridge has been removed.

Other problems associated with large statement printers in automated teller machines involve the need to obtain the maximum useful life out of a printer cartridge and to compensate for the decrease in available ink as a printer cartridge is used. In addition, there is often no satisfactory means for monitoring when the gaper supply which is being used by a statement printer has reached a point where a replenishment is required. This task is particularly complicated because paper is used at different rates, and because stacks of paper are not necessarily uniform. This makes it difficult to determine when replenishment of paper is required.

Another problem with statement printers in automated teller machines involves providing a reliable cutting mechanism for cutting the paper after the statement has been printed. While cutting mechanisms are available, their size and complexity often makes it impractical to use them within an automated teller machine.

Thus there exists a need to provide a statement printer within an automated teller machine that overcomes the deficiencies and problems which have existed in the prior art.

DISCLOSURE OF INVENTION

It is an object of the present invention to provide a statement printer that is capable of printing on large sheets and yet is sufficiently compact to be housed within an automated teller machine.

It is a further object of the present invention to provide a statement printer on which it is easy to change the print cartridge within the restricted space in the interior of an automated teller machine.

It is a further object of the present invention to provide a statement printer which simplifies the loading of paper therein.

It is a further object of the present invention to provide a statement printer that reduces skewing, pucker and prevents folds from being pressed into the paper.

It is a further object of the present invention to provide a statement printer that enables rapid and reliable cutting of wide statement sheets.

It is a further object of the present invention to provide a statement printer that may be operated for long periods without a need for service.

It is a further object of the present invention to provide a statement printer that provides a signal when the paper supply is low.

It is a further object of the present invention to provide a statement printer that maintains the printing quality despite the aging of the ribbon cartridge.

Further objects of the present invention will be made apparent in the following Best Mode for Carrying Out the Invention and the appended claims.

The foregoing objects are accomplished in the preferred embodiment of the invention by a statement printer having a housing. The housing includes a cartridge-supporting top plate that is pivotally mounted. The top plate includes a longitudinally extending channel having a leaf spring extending upwards near a front portion thereof.

A print ribbon cartridge which is replaceably mounted on the top plate includes guides which extend downward in straddling relation of the top plate, so that the print ribbon extends traversely across the bottom of the plate. The print cartridge further includes a pair of spaced, longitudinally extending projections which are accepted in the recess in the top plate in close fitting relation. The projections of the cartridge include a pair of traversely aligned notches wherein the leaf spring is accepted when the cartridge is in properly mounted position. The leaf spring holds the cartridge in the properly aligned location during use.

The cartridge further includes a pair of traversely extending wing projections which extend from opposed sides of the cartridge. The top plate includes a pair of spaced slots for accepting the wing projections therein. The slots serve to hold the cartridge against the top plate and counter the force of the leaf spring.

The cartridge of the present invention may be readily changed within the limited confines of an automated teller machine. The pivoting top plate of the statement printer is tilted upward by turning a release mechanism which disposes the ribbon of the cartridge from the impact area of the print head. The top plate may be pivoted so that the plate extends to a near vertical position. A person may thereafter slide the cartridge off the top plate, providing sufficient initial force so as to disengage the leaf spring from the cut-outs in the spaced projections. Further upward movement of the cartridge disengages the wing projections from the slots and enables the cartridge to be removed as the ribbon is no longer in straddling relation of the top plate.

Thereafter a new cartridge may be installed by bringing a new cartridge adjacent the top plate such that the spaced projections are aligned in interfitting relation with the recess in the top plate. The new cartridge is slid downwardly and forwardly on the top plate such that the wing projections are accepted in the slots and the leaf spring engages the cut-outs in the spaced projections. As this is done the cartridge is automatically positioned so that the guides straddle the top plate and the ribbon is positioned under the top plate for proper printing.

Once the new cartridge is installed, the top plate is returned to its original position adjacent to the print head of the device. The feed rollers of the printer are then operable to move the paper between the top plate and the print ribbon so that the statement information may be printed thereon.

The cooperating print cartridge and top plate enable easy alignment, installation and removal of the cartridge within the limited confines of the interior of an automated teller machine. The design enables an unskilled individual to install the cartridge by "feel" in situations where visibility is limited. Further, the pivoting character of the top plate enables movement to any one of a number of rotational positions wherein the cartridge may be replaced by a person located either in front of or behind the printer. As a result, the statement printer may be readily installed in automated teller machines that are serviced either from the front or the rear. The foregoing objects are further accomplished by a paper cutting apparatus which includes a cutter member mounted in supporting connection with a guide block which supports a print head. The print head prints on adjacent paper as the guide block is moved by a drive transversely back and forth relative to the paper.

An actuating member is mounted in movable supporting connection with the guide block. Adjacent one transverse extreme of movement of the guide block the actuating member engages a first stop. Such engagement moves the cutter member to a cutting position in which it engages the paper and a cutting edge disposed on an opposed side of the paper from the guide block. Moving the guide block transversely across the paper with the cutter member in the cutting position cuts the paper. At an opposite extreme of transverse movement of the guide block the actuating member engages a second stop. Such engagement moves the cutter member away from the paper to a non-cutting position. In one preferred embodiment the cutter is disposed in a direction that is normally away from the cutting edge by a mechanism as the cutter is moved between the cutting and non-cutting positions. One preferred form of the invention further includes a cutter member which includes a cutting disk. A positioning portion on the cutting disk and a cutter biasing mechanism maintain the cutting surfaces in proper relative positions when in the cutting position.

BEST MODES FOR CARRYING OUT INVENTION

Figure 1:
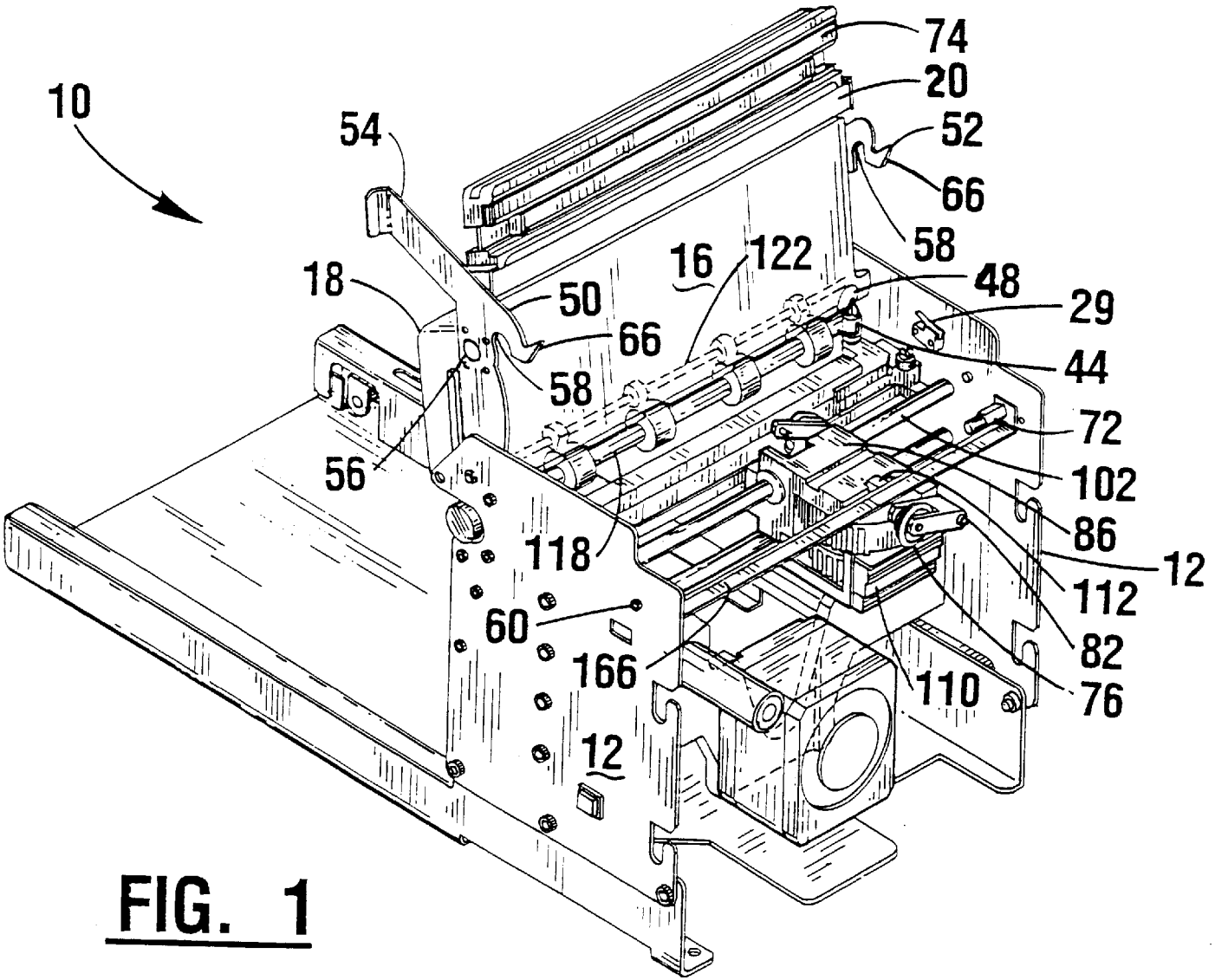
FIG. 1 is an isometric view of the statement printer of the present invention shown with its top plate lifted and with its lower paper guide plate removed so as to expose the print head and cutting mechanism.
Figure 6:
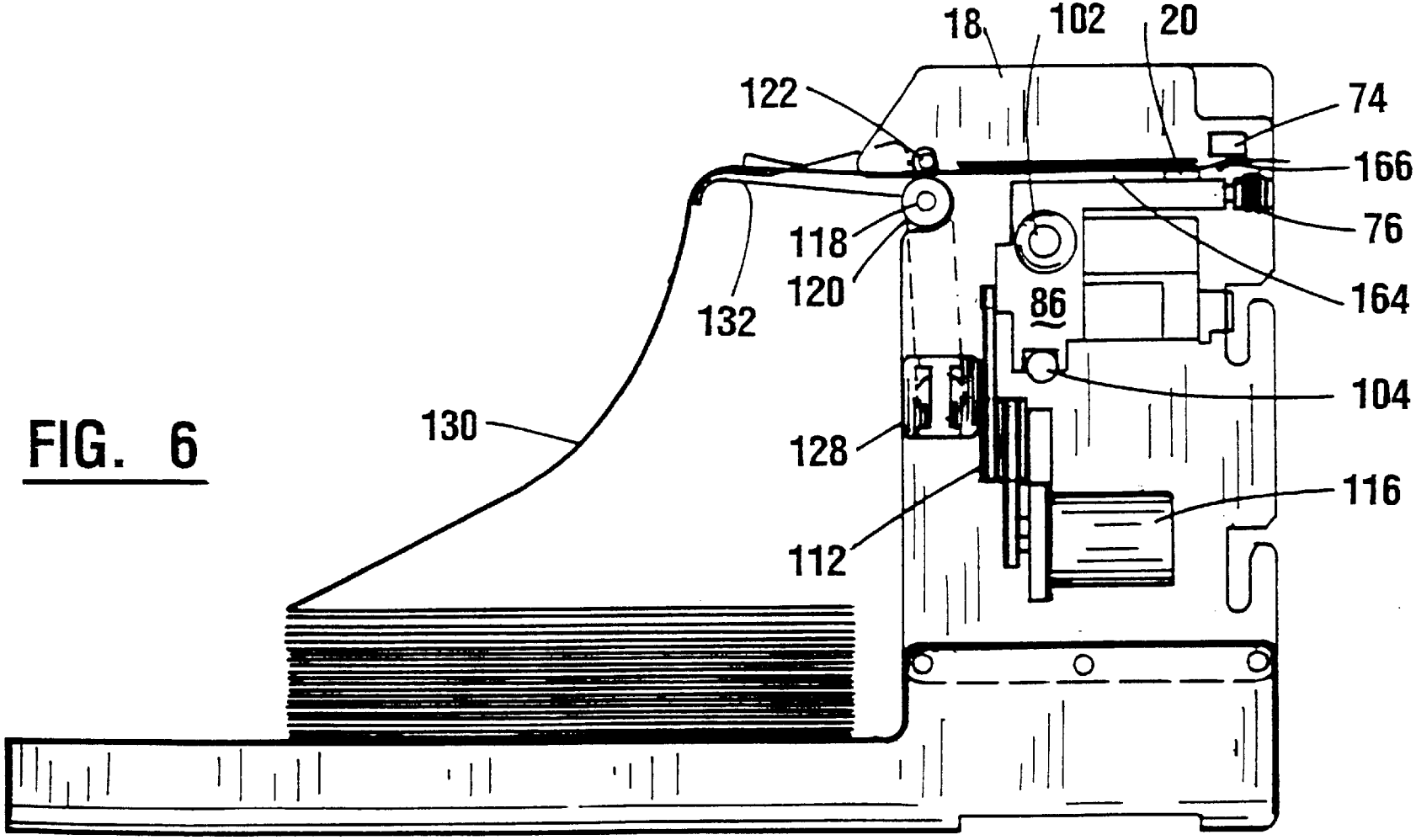
FIG. 6 is a partial cross-sectional side view of the statement printer showing the major internal components thereof.

Referring now to the drawings and particularly to FIG. 1, there is shown therein the preferred embodiment of the statement printer of the present invention, generally indicated 10. The device includes a housing which serves as a supporting frame, including a pair of spaced side walls 12 which are connected to a tray portion generally indicated 14. The device further includes a top plate 16 which is pivotally mounted between the sidewalls. In FIG. 1 top plate 16 is shown in its raised position and the bottom guide plate is removed to expose the other components of the machine. When the printer device is in operation the top plate is in the down and locked position and a lower guide plate is installed as shown in FIG. 6.

Figures 2, 3:
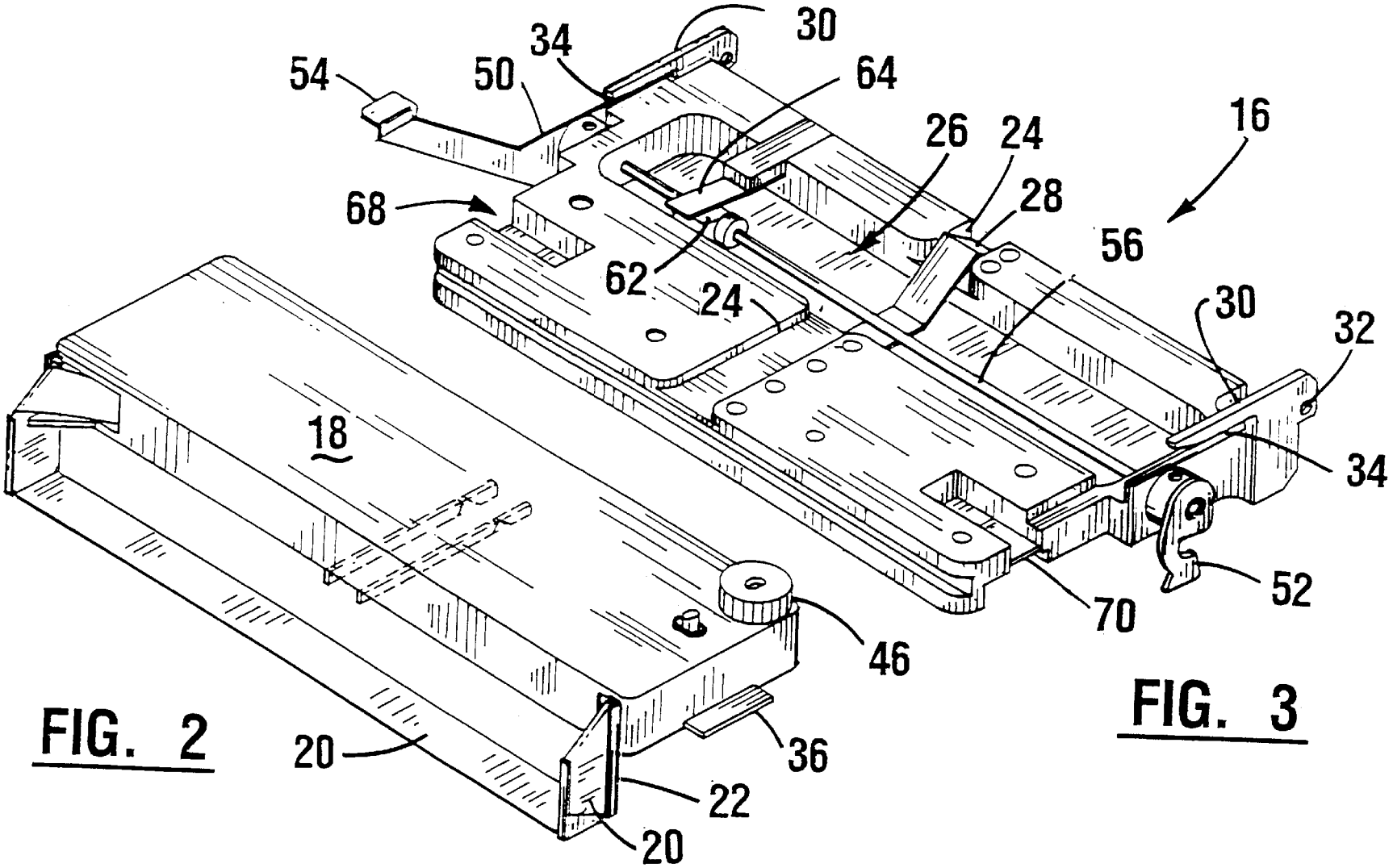
FIG. 2 is an isometric view of the preferred embodiment of the print ribbon cartridge of the present invention.
FIG. 3 is an isometric view of the top plate of the statement printer.

The printer of the present invention includes a print ribbon cartridge 18 which is shown in greater detail in FIG. 2. Cartridge 18 holds a print ribbon 20 which is impregnated with ink and which extends across the underside of the top plate when the print cartridge is mounted thereon. The print cartridge further includes a pair of downward extending ribbon guides 22 which guide the ribbon 20 and straddle the top plate 20 of the statement printer when the cartridge is mounted thereon.

As shown in FIG. 3, top plate 16 includes a longitudinally extending recess 24 in the top thereof. Recess 24 extends on both sides of a laterally extending depressed area 26. A leaf spring 28 extends upwardly in the forward section of recess 24. The leaf spring includes a pointed angled top which is directed upwards.

The top plate further includes a pair of spaced finger projections 30. The finger projections include openings 32 at the front thereof which are sized for accepting a pin that enables the top plate to pivot with respect to the side walls 12. The finger projections 30 also define slots 34 which extend between the projections and the upper surface of the top plate.

Printer cartridge 18 includes on each side an extending wing projection 36. The wing projections 36 are sized for acceptance in slots 34. The wing projections 36 are positioned so that when the cartridge is mounted on the top plate, the finger projections 30 hold the cartridge 18 in close abutting relation to the top plate.

Figure 4:
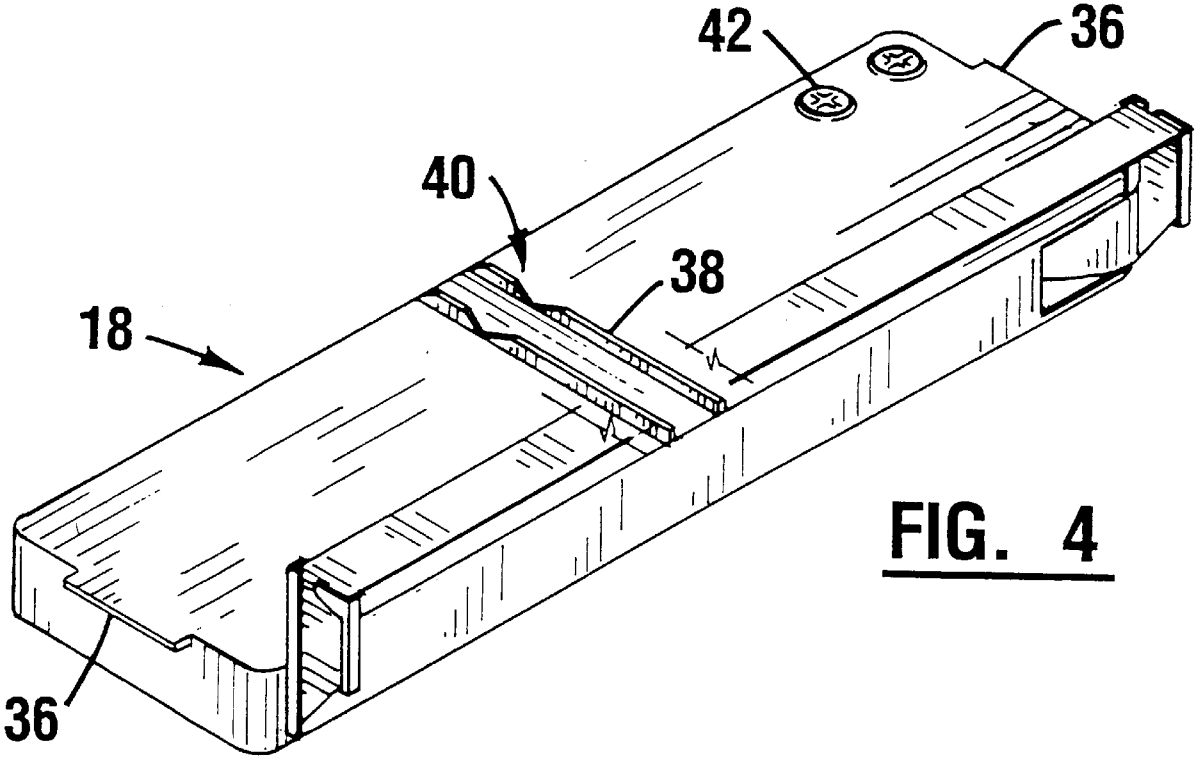
FIG. 4 is an isometric view of the lower surface of the printer cartridge.
Figure 5:
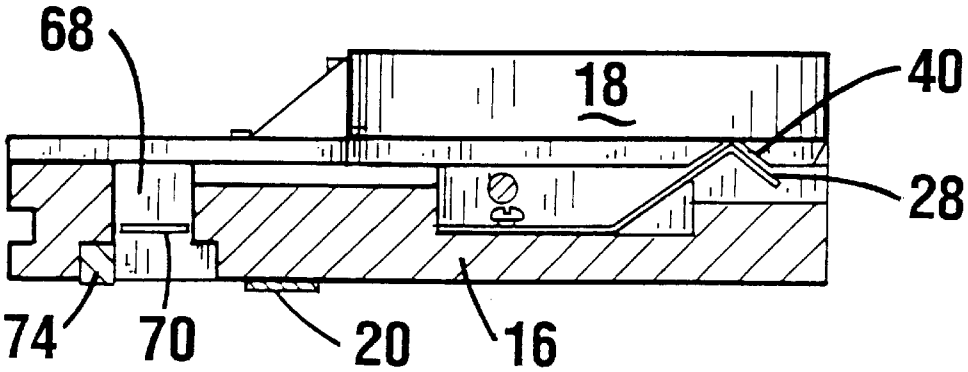
FIG. 5 is a partial cross-sectional view of the top plate with the printer cartridge shown mounted thereon.

As shown in FIG. 4, the lower side of cartridge 18 includes a pair of spaced downward extending projections 38. The downward extending projections extend longitudinally the length of the cartridge. Each includes a V-shaped notch 40 near the front of the cartridge.

When the print cartridge 18 is properly installed on the top plate, the pointed leaf spring 28 nests in the notches 40. In the preferred embodiment the notches are oriented so that the leaf spring is engaged when the wing projections on the cartridge are inserted to the full depth of the slots 34 formed by finger projections 30.

The construction of the print cartridge and top plate assures that the cartridge is in the proper position for printing documents. It further provides for an easy snap-in and snap-out fit. This enables the cartridge to be changed by a non-technician such as a bank teller. A fundamental advantage of this construction is that it is particularly well-suited for use within the confined space inside an automated teller machine. The ability of the top plate 16 to pivot about the openings 32 allows the top plate to be moved out of the printing position through an arc of rotation to a position beyond the vertical. This enables a person to replace the cartridge while standing in a position either in front of or in back of the statement printer.

A further advantage of this design is that the spaced projections 38 on the bottom of the cartridge may be guided by feel in the recess 24 on the back of the plate. As a result, the cartridge may be readily installed in the proper location without the need for the person changing the cartridge to see the exact position of the cartridge. This is particularly important when the printer is mounted in an obscure location within the automated teller machine. The pointed leaf spring 28 also assures that the cartridge 18 is uniformly locked in position on the top plate and the construction enables the technician to feel locking action of the leaf spring against the cartridge, thus assuring proper installation.

As shown in FIG. 4, the cartridge 18 includes a ribbon drive post 42 therein. The drive post has a chamfered, self-centering recess in the bottom thereof which accepts the top of the ribbon drive shaft 44 which is best shown in FIG. 1. The drive post in the cartridge has a knob 46 connected at the top thereof which enables the manual take up of the ribbon.

To enable the ribbon drive shaft to disengage from the drive post of the cartridge during a cartridge change, the top plate includes an opening 48 therethrough (see FIG. 1). This enables the cartridge and the plate to move away from the ribbon drive shaft as the top plate 16 is raised. Of course, when the top plate is lowered, the ribbon drive shaft 44 extends upward through opening 48 and engages the recess in the bottom of the ribbon drive post 42 of the cartridge. As a result, a person changing the ribbon cartridge in the statement printer need not be concerned about disengaging the drive mechanism for the ribbon, as it will automatically occur when the top plate is raised.

As shown in FIGS. 1 and 3, the top plate 16 includes a pair of latching levers 50 and 52. Latching lever 52 includes a handle portion 54. The latching levers are connected by a shaft 56 that extends through the depressed area 26 in the top of the top plate 16. The latching levers 50 and 52 each include recesses 58 that accept and latch on pins 60 that extend outward on the side walls 12 of the device. The engagement of pins 60 in the recesses serves to latch the top plate in position.

As shown in FIG. 3, a cam 62 on shaft 56 engages a flat spring 64 which biases the latching levers 50 and 52 towards the engaging position. An advantage of this design is that the latching levers will tend to be in the position shown in FIGS.

1 and 3 unless manual force is applied to the handle portion 54. If the top plate should fall downward, the bottom faces 66 of the latching levers will engage the pins and prevent the top plate from slamming against the print head, cutter or other components of the statement printer assembly.

The top plate further includes a pair of lateral recesses 68 which have flat springs 70 mounted therein. When the top plate is engaged to pins 60 by the latching levers, the flat springs 70 are biased upwardly by pins 72 that extend inward from the side walls. The biasing action of the leaf springs 70 against the pins 72 provides for solid positioning of the top plate when it is latched in the down position.

The top plate further has a cutter bar 74 mounted thereon. The cutter bar is comprised of hardened metal and is positioned in a recess in the bottom side of the top plate. The cutter bar cooperates with a cutter disk 76 which serves as a cutter member to cut the paper that has been printed on by the statement printer as hereafter described.

As best shown in FIGS. 1 and 19 through 27, the cutter disk 76 has an outer tapered band 78 and a central band 80. As later explained, the tapered band is sized for being in close abutting relation with the trailing edge of the cutter bar 74 to slice through the paper as the cutter disk moves across a sheet of paper.

Figure 26:
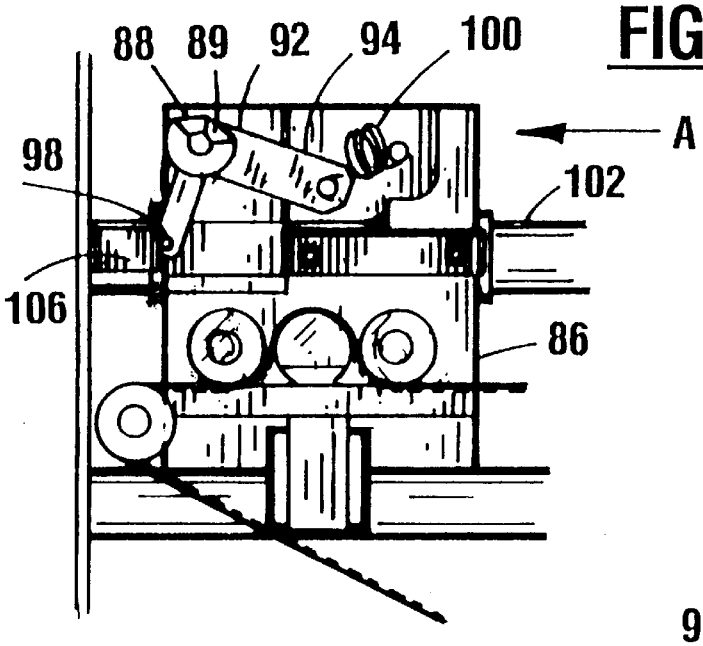
FIG. 26 is a front view of the print head and actuating lever shown in the retracted position.
Figure 27:
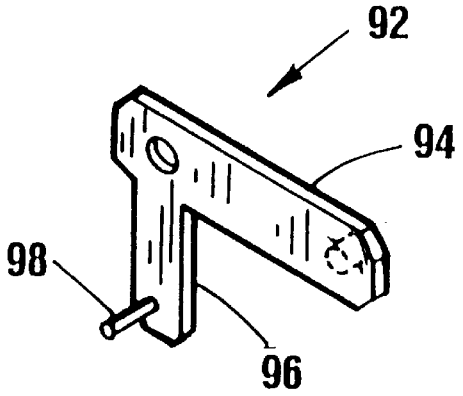
FIG. 27 is an isometric view of the actuating lever which serves to move the cutter mechanism.
Figure 25:
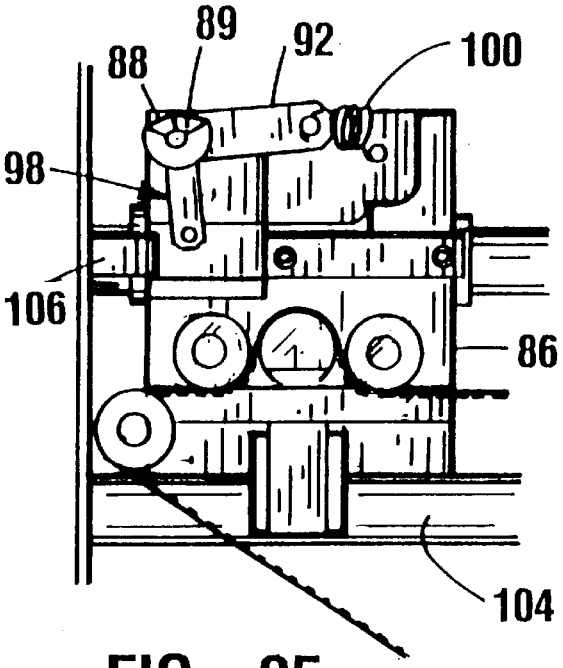
FIG. 25 is a front view of the print head and cutter mechanism with the actuating lever shown in the cutting position.
Figure 28:
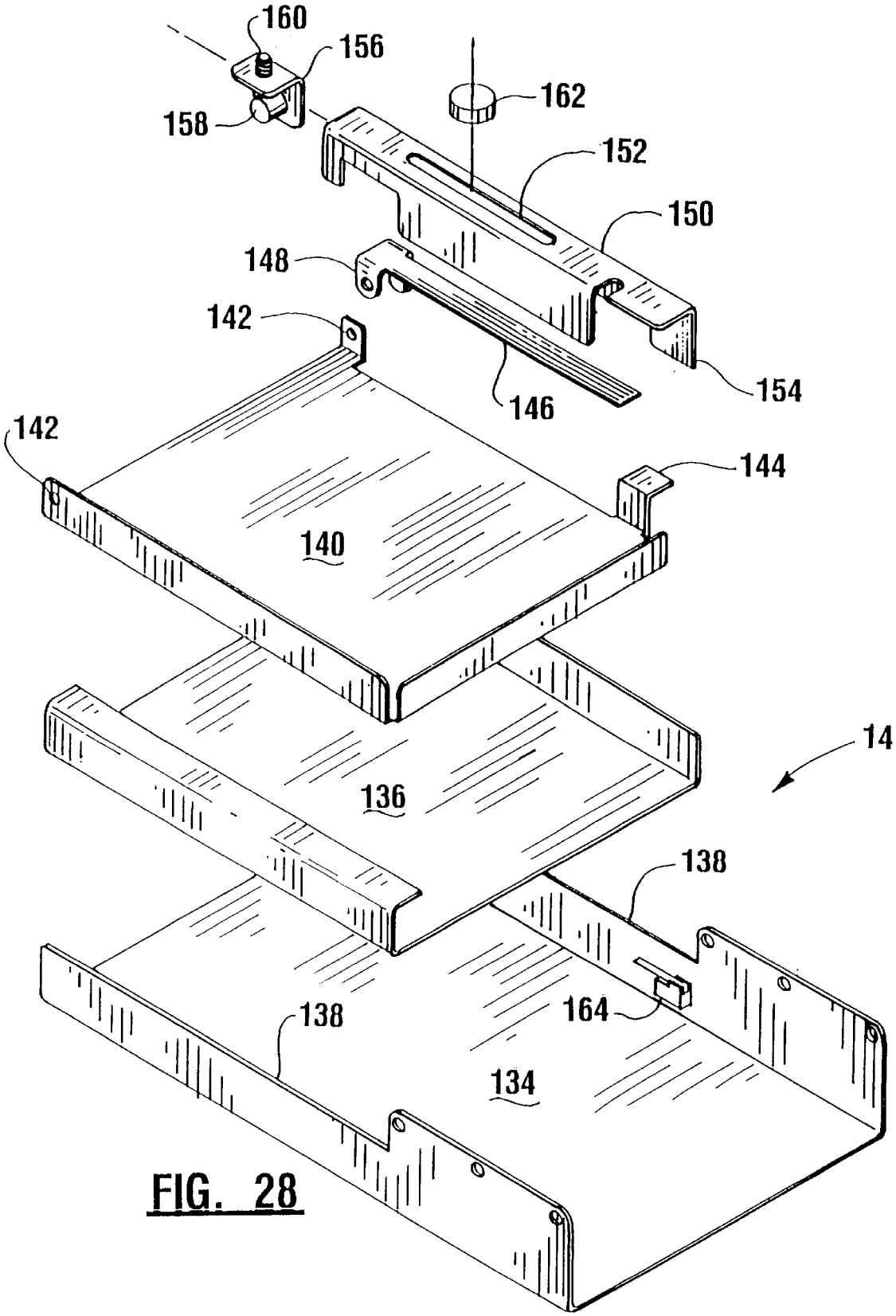
FIG. 28 is an exploded isometric view of the paper holding tray and low paper actuating mechanism of the present invention.

Cutter disk 76 is mounted in a u-shaped arm 82 in a u-shaped recess as shown. The u-shaped arm is mounted to a shaft 84. Shaft 84 extends through a print-head guide block 86. A spring-loaded button head 88 is mounted on shaft 84 at the opposed end of the guide block from arm 82. The button head 88 is biased in the forward direction by a coil spring 90. An actuating lever 92 that is best shown in FIGS. 25 through 27 is mounted on shaft 84 between the button head 88 and the spring 90. Actuating lever 92 has a first arm 94, and a second arm 96 extending perpendicular to its first arm. The second arm 96 has a pin 98 extending forward therefrom as best shown in FIG. 27. First arm 94 has a pin thereon that is connected to a torsion spring 100. Torsion spring 100 has an opposed end that is connected to a spring-mounting pin on the guide block.

As best shown in FIGS. 25 and 26, actuating lever 92 operates to move shaft 84 (and consequently cutter disk 76) up and down. Guide block 86 is driven by a belt drive inside the housing, as later explained. The guide block is mounted on an upper guide rod 102 and a lower guide bar 104 (see FIG. 30). Lever stops 106 are in aligned arrangement with pin 98 on the actuating lever, and are positioned at the extremes of travel of the guide block as best shown in FIGS. 25 and 26. As the guide block 86 moves in the direction of arrow A as shown in FIG. 26, the pin 98 on actuating lever 92 engages lever stop 106. When this occurs, the actuating lever is rotated in a counter-clockwise direction as shown in FIGS. 25 and 26, so that the first arm 94 moves upward. The torsion spring 100 serves to bias the actuating lever and keep it in this position. When the guide block moves to the other extreme of its travel at the opposed end of the housing, pin 98 engages another lever stop. This opposite hand lever stop when engaged moves the lever back to the position shown in FIG. 26. The torsion spring then operates to bias the actuating lever to this position. The torsion spring 100 thereby operates to hold the lever 92 in whichever one of the positions it is currently in.

Figure 19:
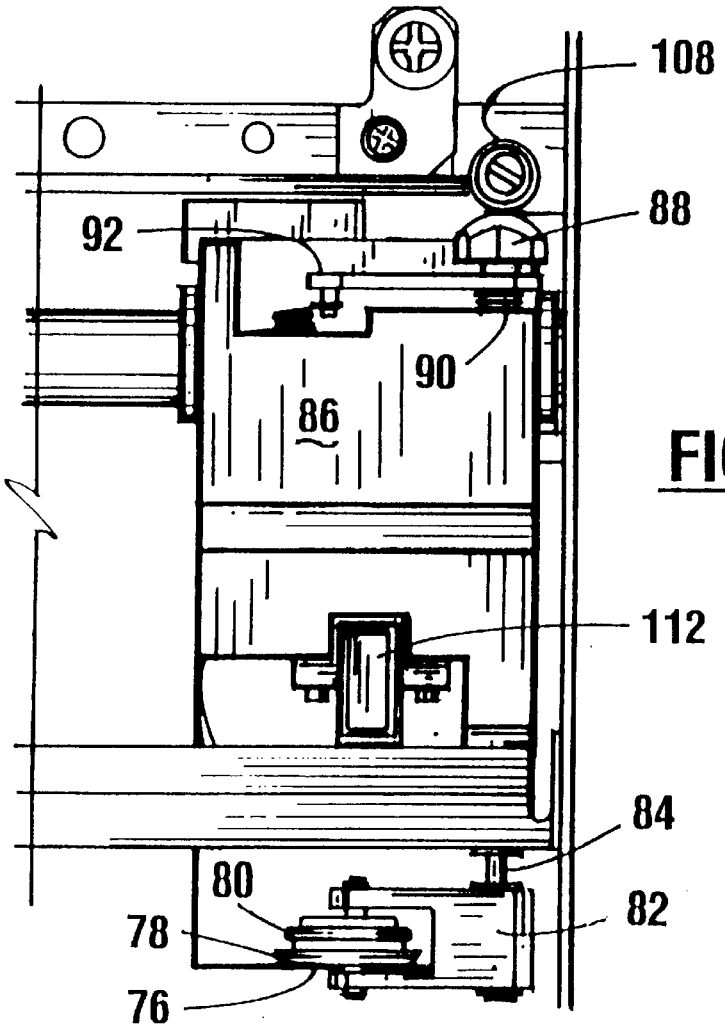
FIG. 19 is a top view of the print head and cutter mechanism of the statement printer.
Figure 20:
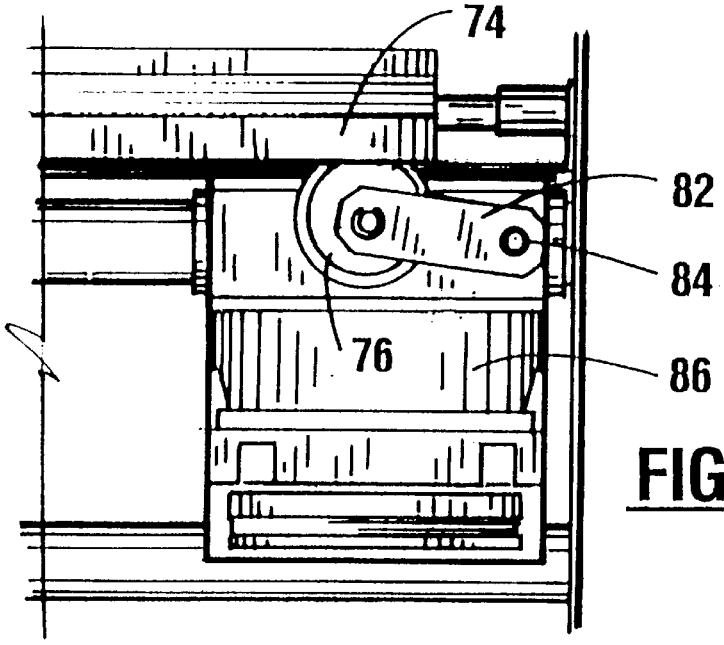
FIG. 20 is a back view of the print head shown in FIG. 19 with the cutter wheel shown in a cutting position.

As previously discussed, actuating lever 92 is connected through shaft 84 to the cutter disk 76. As a result, the rotation of shaft 84 by the actuating lever causes the cutter disk to move correspondingly up and down. Thus when the guide block reaches one extreme of its travel as shown in FIGS. 19 and 20, the cutter disk will move up. Thereafter when the guide block reaches the other extreme of its travel which is shown in FIGS. 21 through 24, the cutter will move down.

Figure 21:
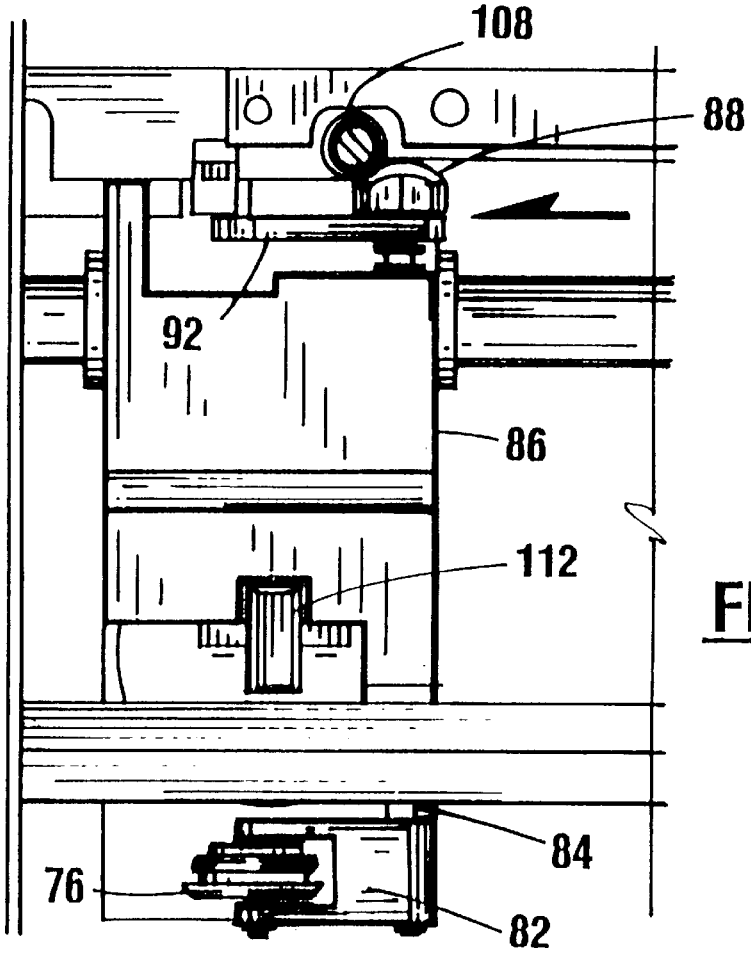
FIG. 21 is a top view of the print head and cutting wheel of the statement printer of the present invention shown in the cutting position.
Figure 22:
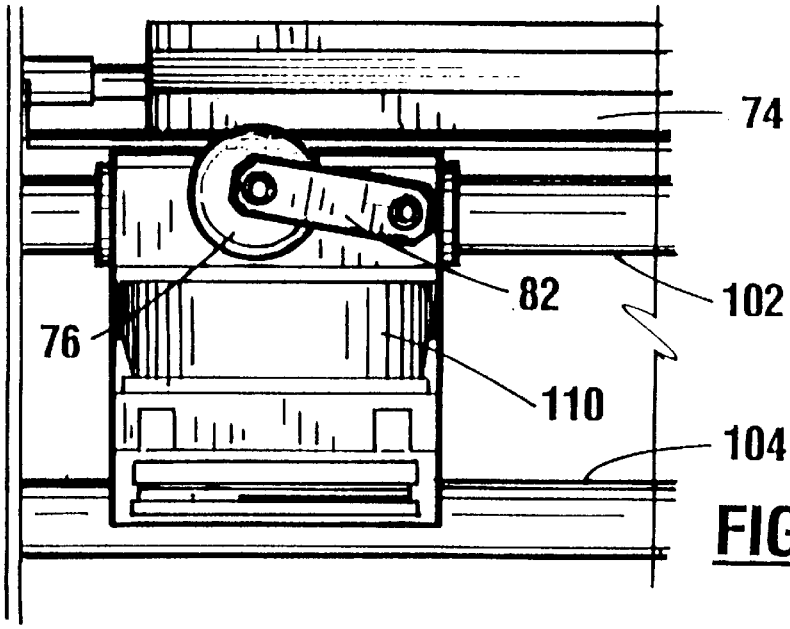
FIG. 22 is a back view of the print head and cutter shown in FIG. 21.
Figure 23:
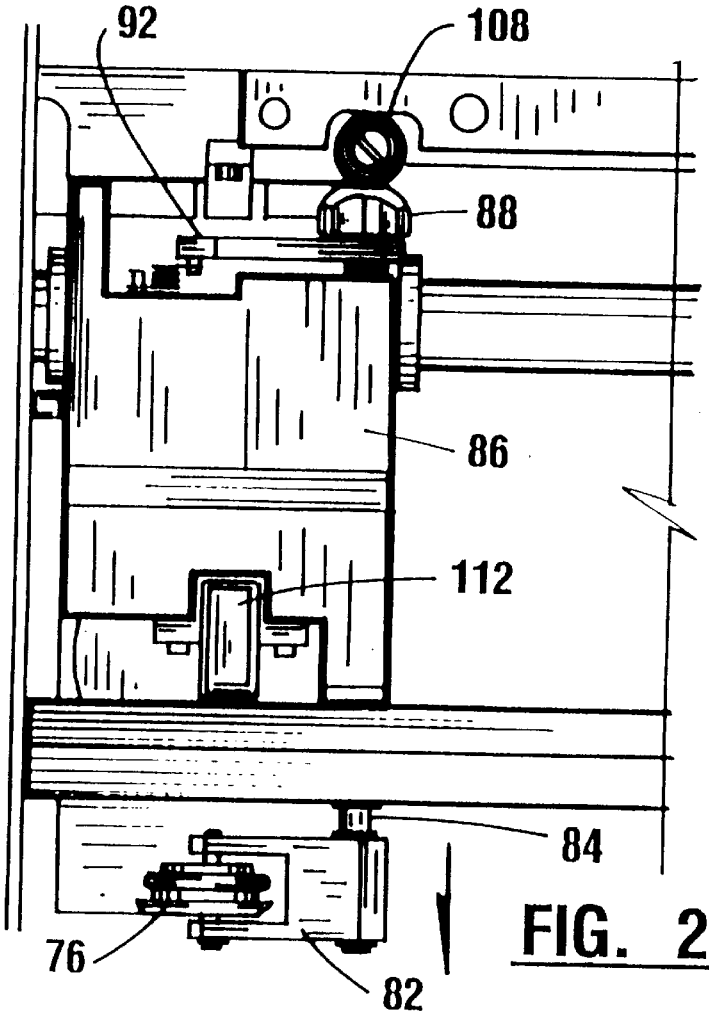
FIG. 23 is a top view of the print head and cutter mechanism shown with the cutter in a retracted position.
Figure 24:
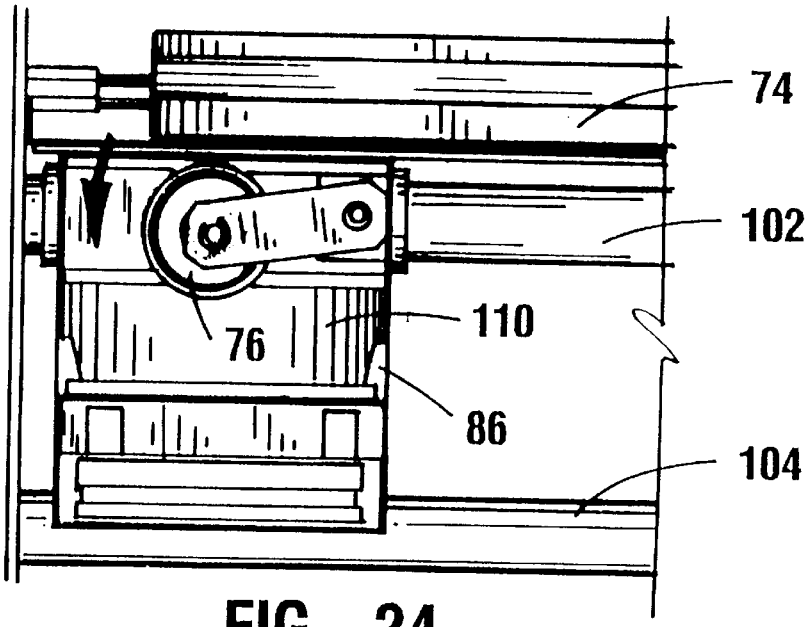
FIG. 24 is a back view of the print head and cutter shown in FIG. 23.

In addition, the cutter mechanism of the present invention has a cutter disposing mechanism which includes cam rollers 108 at the extremes of travel of the guide block. As shown in FIGS. 19, 21 and 23, the function of the cam rollers is to depress the button head against the force of coil spring 90. This causes the cutter disk to move outwardly. The button head includes flattened cam engaging surfaces 89 thereon, to facilitate ease of engagement with the cam rollers and to facilitate the rotation of the button head (FIGS. 25–26). When the guide block moves so that the button head disengages from a cam roller, the cutter disk moves under the force of spring 90 inward towards the guide block. As a result, if the cutter disk is in the upward position, the tapered band 78 will be positioned abuttingly against the edge of the cutter bar 74. This enables a clean, sharp cut of the paper.

At the other extreme of travel of the guide block, when the cutter disk is retracted downward, the engagement of the cam roller and the button head again moves the cutter disk away from the cutter bar and allows it to be readily retracted. As a result, the cam rollers minimize the risk of possible impacts between the cutter disks and the edge of the cutter bar and further serve to minimize the friction associated with engaging and disengaging the cutting disk and the cutter bar. In addition, the central band 80 on the cutter disk rides on the bottom of the cutter bar and serves to provide precise positioning of the cutter disk.

In operation, when it is desired to cut the paper that is passing through the machine, guide block 86 is moved to the extreme of travel shown on the right side of the device in FIG. 1. This causes the cutter disk to rise and engage the cutter bar which position is referred to herein as a cutting position. The guide block then moves traversely across the paper which the cutter disk cuts along the entire length of the cutter bar. When the guide block reaches the other side of the housing, the cutter disk retracts downward which is referred to herein as a non-cutting position.

As previously mentioned, the guide block 86 which serves a movable supporting member, also has mounted thereon a print head 110. The print head includes a plurality of impact pins (not separately shown) which are positioned in an impact area 112. As best shown in FIG. 1, the impact area 112 of the print head is positioned below ribbon 20 when the top plate 16 is in the down position.

Figure 7:
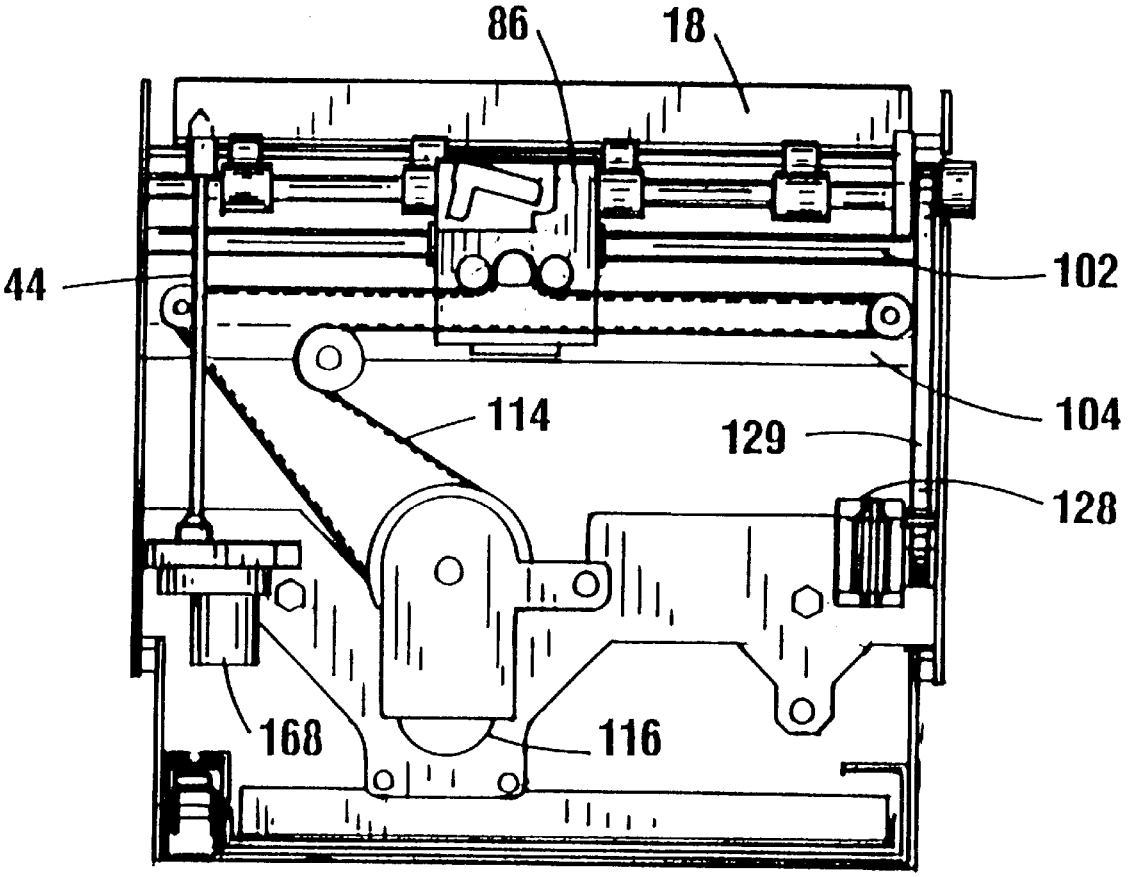
FIG. 7 is a partial cross-sectional front view of the statement printer showing the drive mechanism for the print head.
Figure 30:
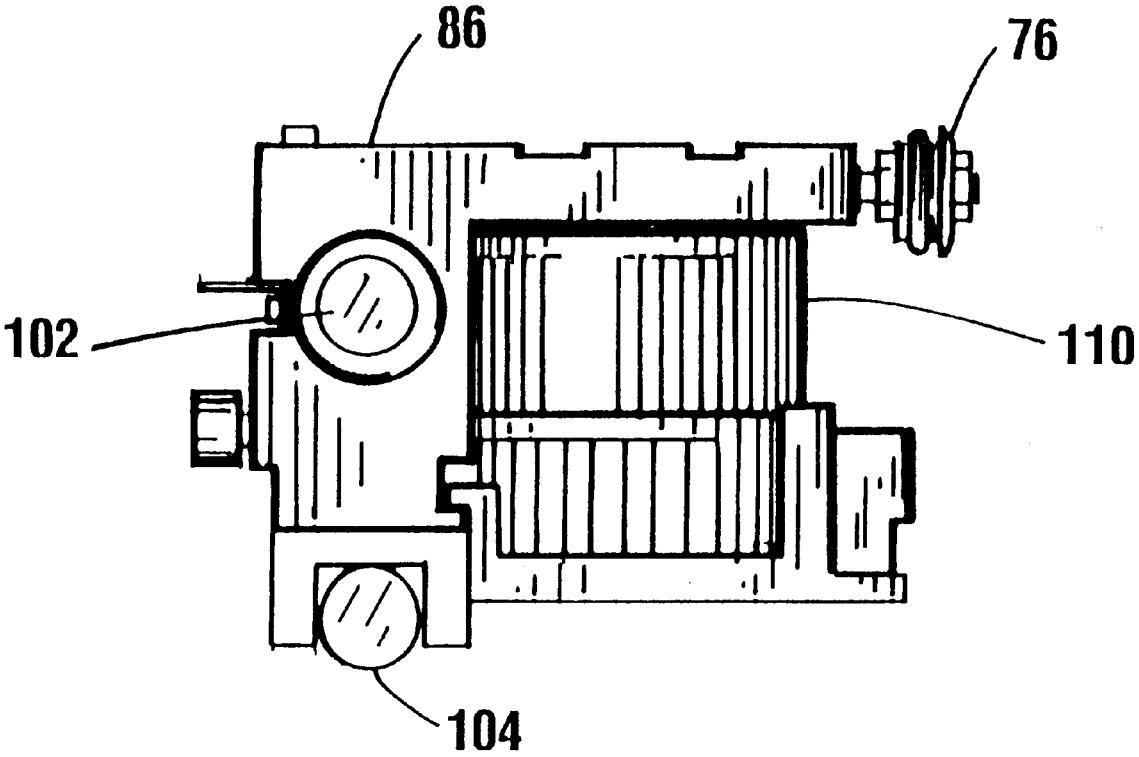
FIG. 30 is a side view of the print head, guide block and cutter mechanism.

As best shown in FIGS. 6, 7, and 30, the print head is driven back and forth in the housing of the statement printer on upper guide rod 102 and lower guide bar 104. The guide block 86 which holds the print head is moved by a belt 114. Belt 114 is driven by a motor 116 which drives the belt through a pulley arrangement. In operation the motor controls movement of the guide block and thus selectively moves the print head back and forth as printing is accomplished on the paper.

When the statement is printed and the paper is advanced in the manner hereafter described, the motor moves the guide block 86 to the first extreme of travel to raise the cutter disk 76, moves it across the sheet, cutting the paper, until it reaches its other extreme of travel where the cutter retracts. The cut statement is then ready to be passed on to the next device, which in the preferred form of the invention is a statement presenter which stacks the statements and presents the stack to the ATM customer.

Figure 9:
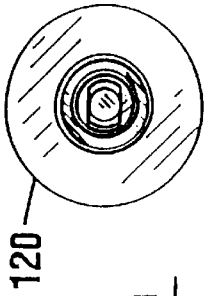
FIG. 9 is a side view of a drive roller on the lower drive roll shaft shown in FIG. 8.
Figure 8:
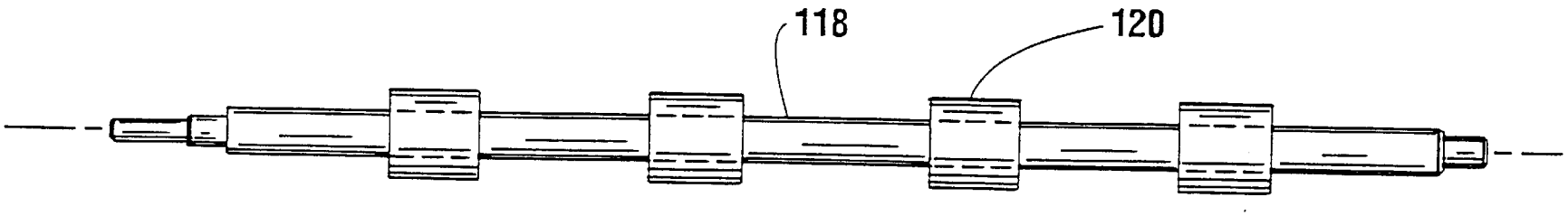
FIG. 8 is a plan view of the lower drive roll shaft of the statement printer.
Figure 10:
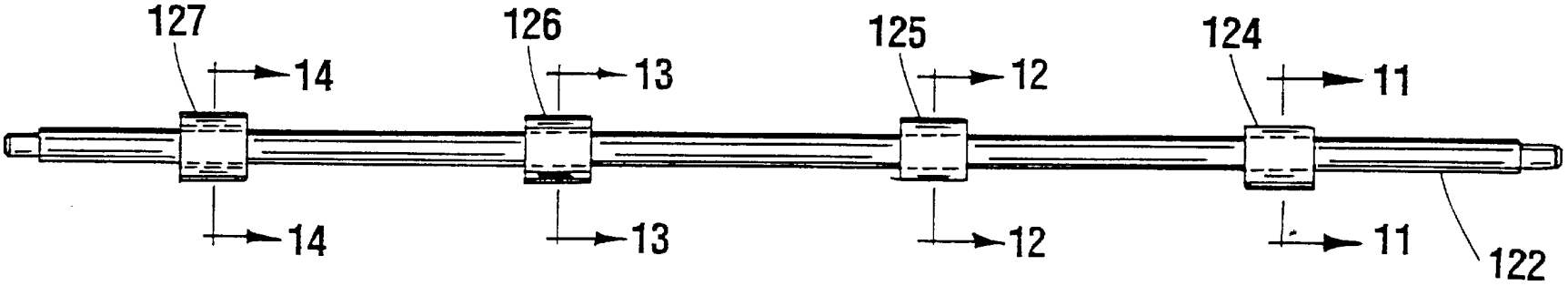
FIG. 10 a plan view of the upper drive roll shaft of the statement printer.
Figure 11:
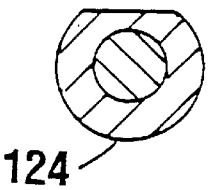
FIG. 11 is a cross-sectional view of a drive roller taken along line 11—11 in FIG. 10.
Figure 12:
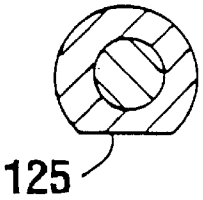
FIG. 12 is a cross-sectional view of a drive roller taken along line 12—12 in FIG. 10.
Figure 13:
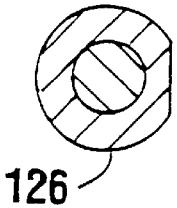
FIG. 13 is a cross-sectional view of a drive roller taken along line 13—13 in FIG. 10.
Figure 14:
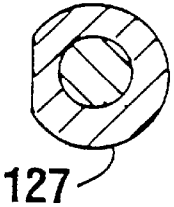
FIG. 14 is a cross-sectional view of a drive roller taken along line 14—14 in FIG. 10.

A further novel feature of the present invention is the ability of the invention to remove puckers and creases from the paper passing therethrough. The invention includes a lower roll shaft 118 which is best shown in FIGS. 8 and 9. Lower roll shaft 118 has 4 round rubber rolls 120 mounted thereon. The rolls 120 are preferably rubber or other material that is suitable for providing good frictional engagement with the paper to be moved through the statement printer. The invention further includes an upper roll shaft 122 which, as shown in FIG. 1, is preferably located above and adjacent to lower roll shaft 118.

As best shown in FIGS. 10 through 14, upper roll shaft 122 has 4 flat spot rolls 124, 125, 126 and 127 mounted thereon. As shown in FIGS. 11 through 14, the flat spot rolls each have a flat spot. The flat spot on each roll is angularly disposed from the flat spot on an adjacent roll. The flat spots are sized so that when a flat spot is directed towards an adjacent lower roll 120, the paper is enabled to move laterally in between. However, paper control is maintained by always providing contact with at least two drive rollers at all times. During each rotation of upper roll shaft 122, each of the flat spots on the rollers passes the adjacent roll.

As shown in FIG. 6, lower roll shaft 118 is driven by a motor 128. Motor 128 is a stepping motor which drives a toothed belt 129 which engages a pulley on the lower roll shaft. Motor 128 enables accurate control of the rotation of the lower roll shaft and the rolls 120 thereon. The upper roll shaft 122 has its rolls 124, 125, 126 and 127 generally in engagement with the rolls 120. As a result, the upper roll shaft rotates therewith.

Figure 15:
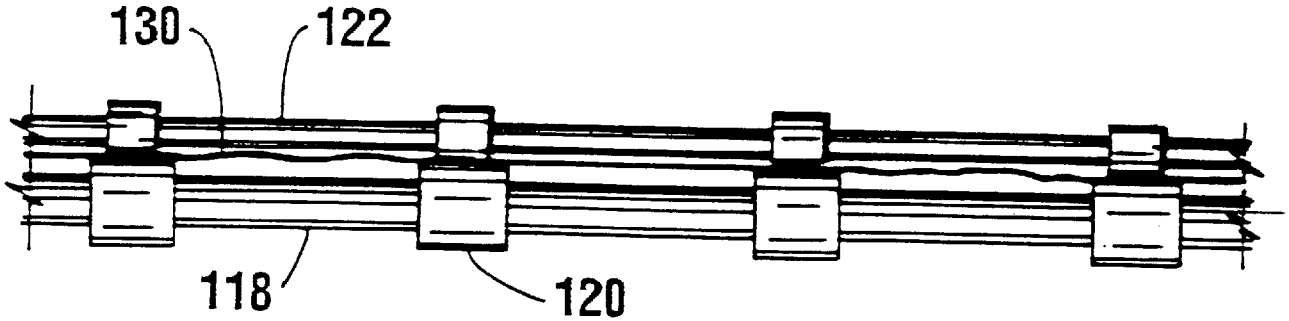
FIG. 15 is a side view of the upper and lower drive rollers showing statement paper between the rollers having creases and puckers therein.

The use of the flat spot rolls enables the smoothing of puckers and creases in the paper that is passed through the statement printer. It also avoids pressing folds into the paper as often occurs with other printers. This is best illustrated in FIGS. 15 through 18. As shown in FIG. 15, the paper 130 between the rolls will sometimes have puckers or creases as shown between the outboard rolls in FIG. 15. This is particularly common after the paper has first been fed into the rolls. This is more of a problem with wide paper, and is more common within an automated teller machine wherein there is limited room, and it is difficult to see and the paper is prone to misalignment.

Figure 16:
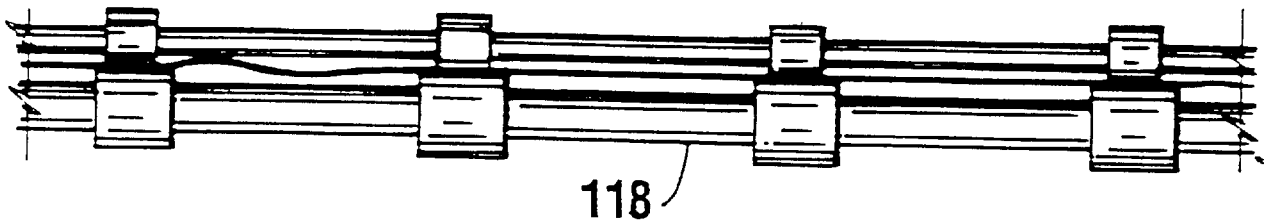
FIG. 16 is a view similar to FIG. 15 showing the paper after having moved a distance through the rollers.
Figure 17:
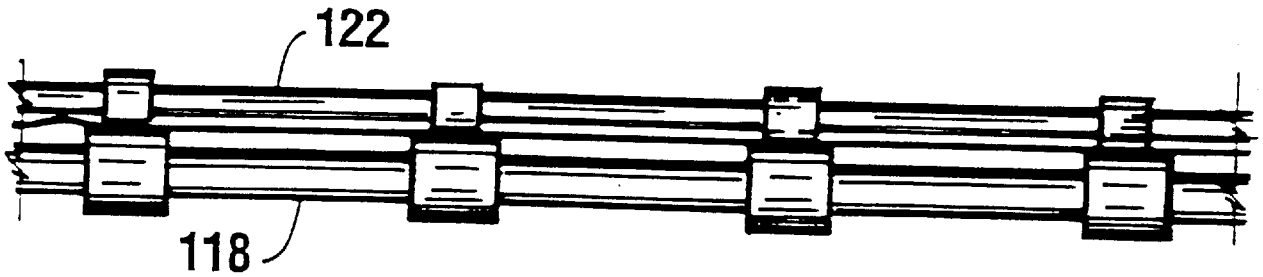
FIG. 17 is a view similar to FIG. 16 showing the paper after it has undergone further movement.
Figure 18:
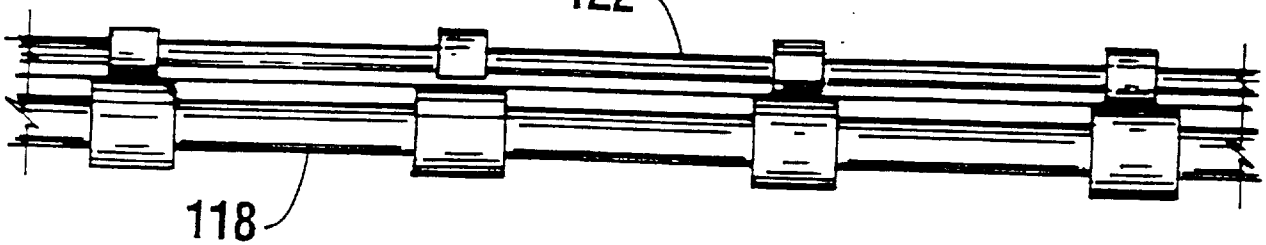
FIG. 18 is a view similar to FIG. 17 showing the paper after the rollers have undergone further movement and showing the final orientation of the paper without creases or puckers.

As shown in FIGS. 16, 17 and 18, as each of the flat spots on the flat spot rolls approaches the face of the cooperating roll 120, the puckers and creases are enabled to smooth out because the paper 130 may move laterally. As a result, within a matter of a very few rotations the paper has reached a perfectly smooth and aligned condition as shown in FIG. 18. Of course, the statement printer also has a paper lead-in tray 132 as shown in FIG. 6 which includes upright guiding edges thereon to urge the paper to track straight and to help a technician who must initially feed the paper between the rolls of the statement printer.

In the preferred embodiment of the invention, the guide rolls are operated under control of a printer control which includes a processor. Each time the top plate 16 is lowered, which indicates a paper jam or a cartridge change, the processor causes the rolls to drive the paper back and forth several inches. This removes puckers and creases in the paper and assures that the paper extends above the ribbon 20. As shown in FIG. 1, a switch 29 is used to sense when the top plate has been moved to the down position. Switch 29 also serves to verify that the top plate is properly latched before printing is commenced.

Another novel feature of the statement printer of the present invention is its ability to accommodate large stacks of paper. This enables the printer to operate unattended for a long period of time. However, any stack of paper will eventually be depleted and require replenishment.

Figure 29:
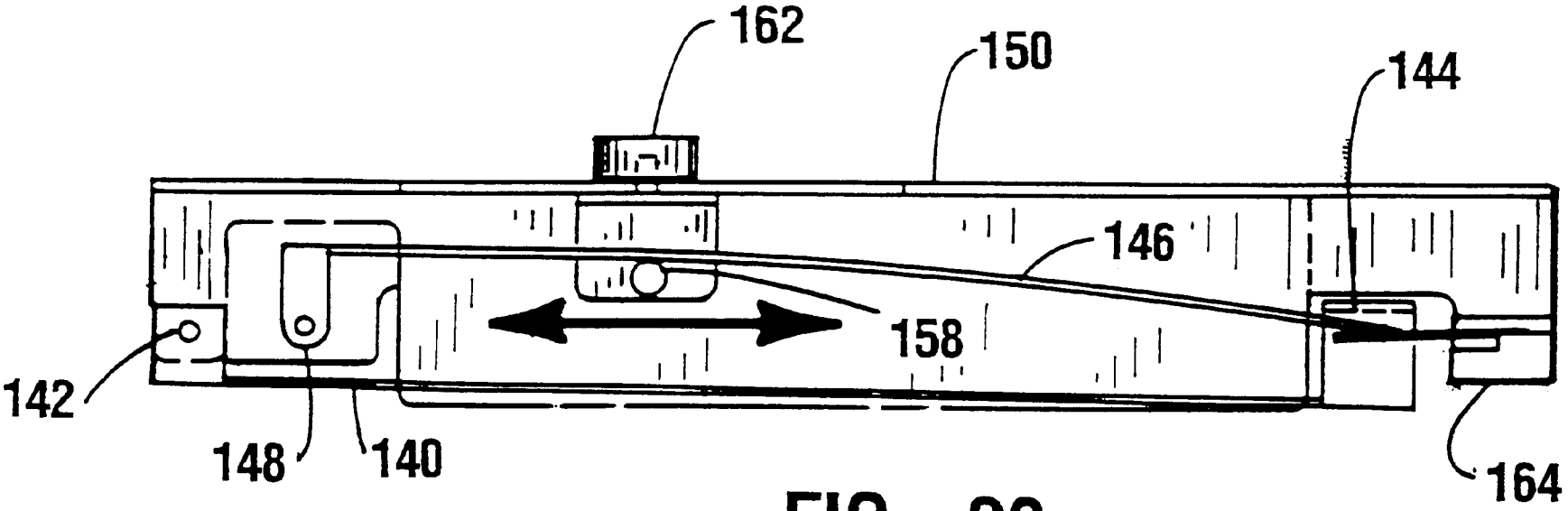
FIG. 29 is a partial cross-sectional view demonstrating the operation of the low paper actuating mechanism of the present invention.

The statement printer of the present invention includes a novel mechanism which enables the printer to provide a signal when the paper is low. As shown in FIG. 29 the tray portion 14 of the device includes an outer tray 134 and a middle tray 136 which nests within the upright walls 138 of the outer tray. An inner tray 140 is positioned inside the middle tray 136. The inner tray 140 includes a pair of pivots 142 at the rear thereof. The pivots 142 suspend the rear of the inner tray slightly above the surface of the middle tray 136. As a result the inner tray 140 is pivotally movable to a slight degree within the middle tray 136.

The inner tray further includes a tab 144 which extends laterally outward therefrom. A leaf spring 146 includes a yoke 148 which has a pin extending therethrough (see FIG. 29). The pin extending through yoke 148 extends through the wall of the middle tray 136 and engages the upright walls 138 of the outer tray. The mechanism further includes an overlying bracket 150 which has a slot 152 therein. The bracket 150 includes a downward-extending flange 154 which engages an upright wall 138 of the outer tray and is fixably mounted thereto by conventional fastening means.

An adjusting slider 156 is mounted below bracket 150. Slider 156 includes a roller pin 158 which extends below leaf spring 146. Slider 156 further includes a threaded stud 160 which extends upward through slot 152 and is threadably engaged with a knob 162. As shown in FIG. 29, leaf spring 146 engages the underside of tab 144. As a result, leaf spring 146 tends to bias the front of the inner tray 140 upward. Because stud 160 is selectively movable in slot 152, the amount of biasing force exerted by leaf spring 146 on tab 144 is adjustable. This enables selective adjustment of the weight of th paper that can reside on inner tray 140 before tab 144 will rise upward in response to the biasing force.

An electrical switch 164 is positioned to actuate in response to the rising of tab 144 and to generate a signal. As a result when the weight of the paper on the inner tray 140 has decreased to a point where the biasing force of the leaf spring 146 overcomes the weight of the paper, switch 164 will send a signal which indicates that the amount of paper available for the statement printer is low and needs to be replaced.

In the preferred form of the invention, bracket 150 adjacent to slot 152 is graduated to indicate the positions of knob 162 which correspond to the amount of paper remaining when the inner tray will rise and provide a signal. This enables accurate setting of when the low paper signal is given. In addition, large amounts of paper may be placed on the inner tray 140 without causing any damage, as the movable front of the inner paper tray will not move any further than to engage the upper surface of middle tray 136. As a result, the statement printer of the invention provides a reliable and accurate indication of when the paper is low. This enables it to run unattended for long periods of time.

In alternative embodiments of the invention the middle tray may be eliminated. In such designs the inner tray is pivotally mounted directly in the outer tray.

As best shown in FIG. 6, the path of paper 130 through the statement printer is through the lead-in tray 132 and between the rollers on the upper and lower roll shafts 122 and 118 respectively. The paper then passes below the top plate 16 and above a lower guide plate 164 which extends above the guide block 86 and the print head 110 so as to support the paper. The guide plate 164 terminates rearwardly where the printer ribbon 20 passes under the top plate 16, and serves to direct the paper above the ribbon. The printer further includes a support plate 166 as best shown in FIG. 1 which is arcuate in cross section and extends between the side walls 12. The support plate holds the paper upward and adjacent to the cutter bar 74. Support plate 166 is preferably coated with a non-stick, plastic material to facilitate free passage of the paper thereover.

In operation, the paper is moved through the statement printer by the action of the rolls 120 which are driven by motor 128. As the paper is advanced, the print head 110 is moved back and forth in the guide block and is operated under the printer control as directed by signals from a remote processor to print the characters on the advancing paper. The print head is operated under the printer control so as to correlate between the advance of the paper by rollers 120 and the movement of the print head 110 across the paper.

A further novel aspect of the present invention is that the computer processor which controls the operation of the print head functions to maintain print quality as the ribbon ages and ink is depleted. Cartridge 18 is such that the ribbon 22 may pass the print head many times during its useful life. The processor which controls the operation of the print head is programmed with information concerning the anticipated depletion of the ink from the ribbon with each pass of the ribbon over the print head and the printing of characters therewith. This information is used to modify the strike force of the pins of the print head 110. As a result, the life of the ribbon as well as the life of the print head is extended.

Figure 32:
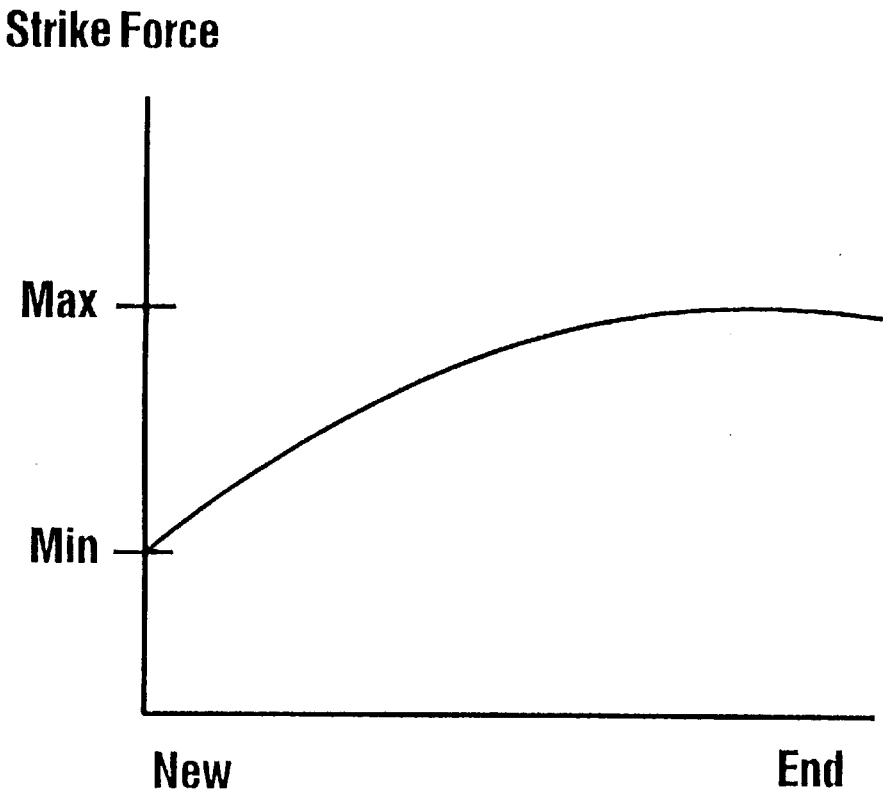
FIG. 32 is a graph of the print striking force used versus ribbon age.
Figure 31:
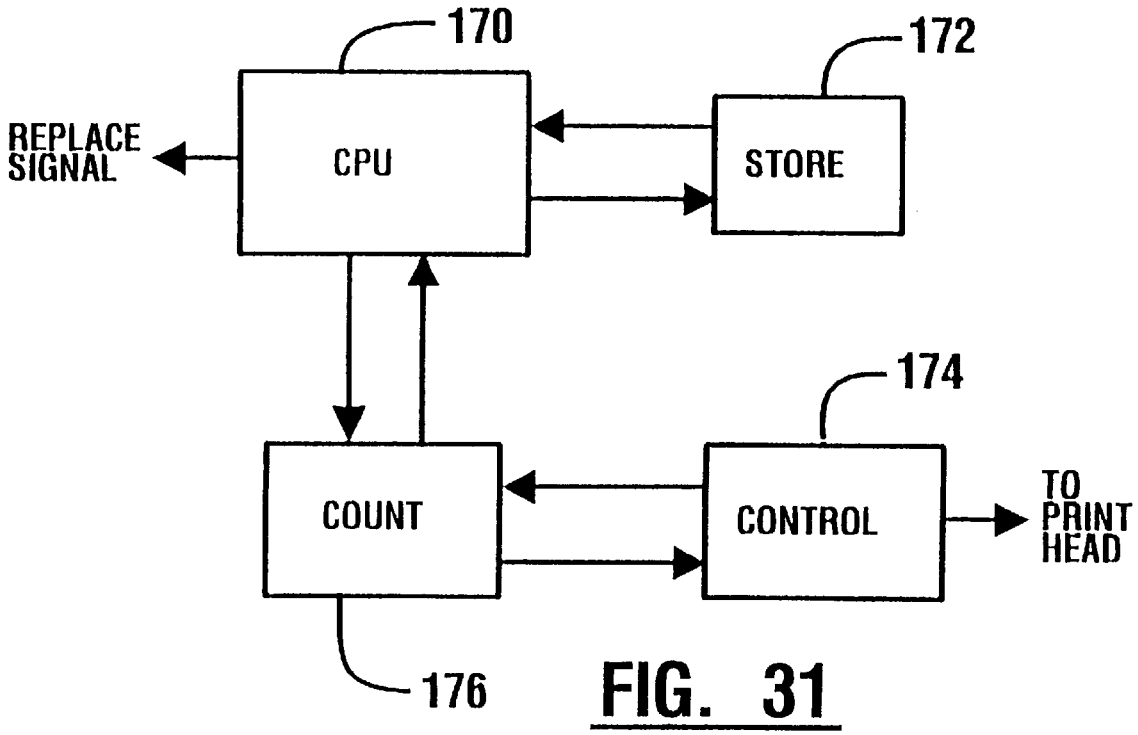
FIG. 31 is a flow chart for the control of the print head.

In operation, a central processor 170 either in the ATM or remote has stored in a non volatile memory 172 associated therewith a "strike force versus age" curve for ribbon cartridge 18 such as shown in FIG. 32. The central processor sends signals representative of characters to be printed to the control module 174 which includes processor and circuitry which drives the printer. The control circuitry is adapted to run in either draft or letter quality modes in accordance with signals from the central processor. This enables the institution operating the ATM to vary the print quality for various types of documents. The signals which are presented to the printer control are generally presented as ASCII characters, however graphics may also be printed by signals presented in a bit mapped format.

The printer control 174 is initialized with a value for the striking force of the needles of the print head 110 based on an initialization signal from the central processor 170. The printer control module 174 then converts the signals into the striking signals for the needles, the signals for the movement of the head and for movement of the rolls 120 that move the paper. The control module 174 changes the pulse width of the electrical signals that drive the needles of the print head. As a result the "newer" the ribbon, the more ink that is present and the less the striking force required to attain the desired print quality. The reduced striking force is attained by lessening the pulse width of the signals that drive the needles.

Upon completion of printing a document the printer control totals the number of needle firings. This number is calculated by a counting routine 176 in the control module. The total is divided by a constant to produce an approximate number of "draft characters". This number is reported to the central processor 120 where it is added to the prior total number of draft characters printed for the ribbon. The total is then stored in the non-volatile memory 172 associated with the central processor.

At the start of the next transaction conducted through the ATM which requires the printer to operate, the central processor 170 reads the accumulated ribbon use data stored in memory 172. It then forwards the data to the printer control module 174 to adjust the pulse width of the signals that activate the needles of the print head 110. As the ribbon cartridge is used and the ink depleted, the strike force of the needles is increased to maintain the print quality.

The printer of the present invention also tracks the use of the ribbon and generates a signal warning of the depletion of the ribbon cartridge. This signal is generated by the central processor based on the amount of characters stored in the memory reaching a preset limit. When the ribbon is replaced the person who replaces the ribbon inputs a signal to the central processor to reset its memory and begin the process anew.

Because the needles of the print head do not strike with full force when the ribbon is new the ink is conserved on the ribbon. This increases the life of the ribbon. Reducing the impact force during much of the print head's use also prolongs its life. This reduces the frequency of maintenance and reduces cost.

Thus the new statement printer of the present invention achieves the above-stated objectives, eliminates difficulties encountered in the use of prior devices and systems, solves problems and attains the desirable results described herein.

In the foregoing description certain terms have been used for brevity, clarity and understanding, however, no unnecessary limitations are to be implied therefrom because such terms are for descriptive purposes and are intended to be broadly construed. Moreover, the descriptions and illustrations given are by way of examples and the invention is not limited to the exact details shown and described.

Having described the features, discoveries and principles of the invention, the manner in which it is constructed and operated and the advantages and useful results attained, the new and useful structures, devices, elements, arrangements, parts, combinations, systems, equipment, operations and relationships are set forth in the appended claims.

We claim:

1. Apparatus comprising:

a supporting frame;

a paper moving mechanism in supporting connection with the frame, wherein the paper moving mechanism is operative to move a paper adjacent thereto along a paper movement direction;

a guide block movably mounted in supporting connection with the frame, wherein the guide block is movable along a direction generally transverse to the paper movement direction;

a drive in operative connection with the guide block, wherein the drive is operative to selectively move the guide block along the transverse direction;

a cutter member movably mounted in supporting connection with the guide block, wherein the cutter member is movable between a cutting position wherein the cutter member engages the paper in cutting relation and a non-cutting position;

an actuating member in operative connection with the cutter member;

a first stop and a second stop, wherein the actuating member is operatively engaged with the first stop in a first position of the guide block and is operatively engaged with the second stop in a second position of the guide block, wherein the second position is disposed in the transverse direction from the first position, wherein when the actuating member operatively engages the first stop the cutter member is moved from the non-cutting position to the cutting position, and wherein when the actuating member operatively engages the second stop the cutter member is moved from the non-cutting position to the cutting position.

2. The apparatus according to claim 1 and further comprising a biasing mechanism in operative connection with the cutter member, wherein when the cutter member is in the cutting position the biasing mechanism is operative to bias the cutter member toward the cutting position.

3. The apparatus according to claim 2 wherein the biasing mechanism is further operative when the cutter member is in the non-cutting position to bias the cutter member toward the non-cutting position.

4. The apparatus according to claim 1 and further comprising a rotatable member in rotatably supporting connection with the guide block, and wherein the actuator member is operatively connected to the rotatable member, wherein the rotatable member rotates in a first rotational direction as the cutter member moves from the cutting position to the non-cutting position, and in an opposed rotational direction as the cutter member moves from the non-cutting position to the cutting position.

5. The apparatus according to claim 4 and further comprising an arm in operative connection with the rotatable member, and wherein the cutter member is in supporting connection with the arm.

6. The apparatus according to claim 5 wherein the cutter member includes a cutter disk, and wherein the cutter disk is rotatably mounted in supporting connection with the arm.

7. The apparatus according to claim 6 wherein the arm includes a u-shaped recess, and wherein the cutter disk is rotatably movable in the recess.

8. The apparatus according to claim 1 and further comprising a print mechanism in supporting connection with the guide block, wherein the print mechanism is selectively operative to cause the printing of indicia on the paper.

9. The apparatus according to claim 1 and further comprising a cutting edge in supporting connection with the frame, and wherein the cutting edge extends adjacent the paper and in generally the transverse direction, and wherein the paper extends between the cutting edge and the guide block, and wherein in the cutting position the cutter member is generally positioned in sufficient proximity to the cutting edge to cut the paper when the cutter member moves in the transverse direction relative thereto, and in the non-cutting position the cutter member is disposed from the cutting edge sufficiently to not cut the paper when the cutter member moves transversely relative thereto.

10. The apparatus according to claim 9 and further comprising a cutter disposing mechanism, wherein the cutter disposing mechanism is operative to move the cutter member away from the cutting edge in generally the paper movement direction as the cutter member moves between the cutting position and the non-cutting position.

11. The apparatus according to claim 10 wherein the disposing mechanism includes a cam member in supporting connection with the frame and adjacent to at least one of the first position and the second position.

12. The apparatus according to claim 10 wherein the disposing mechanism includes a cutter moving member in supporting connection with the guide block, wherein the cutter moving member is movable relative to the guide block both rotatably and in the paper movement direction, wherein the actuating member is in operative connection with the cutter moving member, and further comprising a cam member in supporting connection with the frame, wherein the cam member is in further operative connection with the cutter moving member and is operative to dispose the cutter member from the cutting edge adjacent to at least one of the first position and the second position.

13. The apparatus according to claim 12 wherein the cam member comprises a first cam roller adjacent the first position and a second cam roller adjacent the second position, wherein the cam rollers are operative to dispose the cutter member from the cutting edge when the cutter member moves between the cutting and non-cutting positions.

14. The apparatus according to claim 13 and further comprising a cutter biasing mechanism, wherein the cutter biasing mechanism is in operative connection with the cutter moving member, wherein the cutter biasing mechanism is operative to bias the cutter member towards the cutting edge.

15. The apparatus according to claim 14 and further comprising a guide surface in supporting connection with the frame, wherein the guide surface extends in generally the transverse direction adjacent the cutting edge, and wherein the cutter member includes a cutting portion and a positioning portion disposed generally in the paper movement direction from the cutting portion, and wherein in the cutting position of the cutter member, the positioning portion is in engagement with the guide surface and the cutter biasing mechanism biases the cutting portion into engagement with the cutting edge.

16. The apparatus according to claim 15 wherein the cutter member comprises a cutter disk, and wherein the cutting portion comprises a generally circular portion, and wherein the positioning portion comprises a further generally circular portion.

17. The apparatus according to claim 1 and further comprising an automated teller machine, wherein the cutter member cuts the paper in the automated teller machine.

18. Apparatus comprising:

a supporting frame;

a cutting edge in supporting connection with the supporting frame;

a paper moving mechanism in supporting connection with the frame, wherein the paper moving mechanism is operative to move a paper adjacent thereto along a paper movement direction;

a movable supporting member, wherein the movable supporting member is in supporting correction with the frame and is movable in a direction generally transverse to the paper movement direction and wherein the cutting edge extends generally along the transverse direction and on an opposed side of the paper from the movable supporting member;

a drive in operative connection with the movable supporting member, wherein the drive is operative to selectively move the movable supporting member along the transverse direction;

a print mechanism in supporting connection with the movable supporting member, wherein the print mechanism is selectively operative to print indicia on the paper as the drive moves the movable supporting member along the transverse direction;

a cutter member movably mounted in supporting connection with the movable supporting member, the cutter member being movable between a cutting position wherein the cutter member engages the cutting edge and cuts the paper and a non-cutting position wherein the cutter member is disposed from the cutter edge and does not cut the paper;

a pair of transversely disposed cam members, wherein each of the cam members is engageable in operative connection with the cutter member, wherein operative engagement of the cutter member with each cam member is operative to dispose the cutter member generally along the paper movement direction and away from the cutting edge as the cutter member moves between the cutting and non-cutting positions.

19. Apparatus in an automated banking machine including:

a paper moving mechanism in the machine, wherein the paper moving mechanism selectively moves a paper along a paper movement direction;

a print mechanism in supporting connection with a movable supporting member, wherein the movable supporting member is selectively moved along a direction transverse to the paper movement direction and wherein indicia is printed by the print mechanism;

a cutting edge extending generally along the transverse direction on an opposed side of the paper from the movable supporting member; and a guide surface extending generally transversely adjacent to the cutting edge;

an arm in supporting connection with the movable supporting member, and an actuating mechanism for moving the arm towards the paper to a cutting position in a first transverse position of the movable supporting member and away from the paper to a non-cutting position in a second transverse position of the movable supporting member;

means for mounting a cutter disk in connection with the arm;

an improvement comprising:

a cutter disk, the cutter disk including a tapered band sized for engaging the cutting edge in the cutting position of the arm, wherein in the cutting position the paper is cut by engagement of the cutting edge and tapered band, the cutter disk further including a central band disposed from the tapered band, wherein the central band is sized for engaging the guide surface when the arm is in the cutting position.

20. A method comprising the steps of:

(a) printing on a paper with a print mechanism by moving a movable supporting member in supporting connection with the print mechanism along a generally first transverse direction relative to the paper, wherein the paper is bounded by a first transverse edge and a second transverse edge;

(b) moving the movable supporting member towards the first transverse edge of the paper;

(c) moving a cutter member relative to the movable supporting member from a non-paper cutting position to a paper cutting position adjacent the first transverse edge by operatively engaging the cutter member and a first stop in a first transverse position of the movable supporting member;

(d) transversely cutting the paper by moving the movable supporting member in a second transverse direction towards the second transverse edge of the paper with the cutter member in the cutting position; and (e) moving the cutter member from the paper cutting position to the non-paper cutting position by operatively engaging the cutter member and a second stop in a second transverse position of the movable supporting member.

21. The method according to claim 20, wherein step (b) includes engaging the cutter member with a cutting edge disposed on an opposed side of the paper from the movable supporting member, wherein the cutting edge extends generally in the transverse direction, and wherein step (c) comprises moving the cutter member from a position disposed from the cutting edge in a direction generally normal to the transverse direction, to a position wherein the cutter member engages the cutting edge.

* * * * *